US009687063B2

(12) United States Patent
Paduano et al.

(10) Patent No.: US 9,687,063 B2
(45) Date of Patent: Jun. 27, 2017

(54) AUTOMATIC OPENING FOR A COMPARTMENT IN A PACK

(71) Applicant: North Face Apparel Corp., Wilmington, DE (US)

(72) Inventors: Matthew Edward Paduano, Orinda, CA (US); Christopher K. Tagumi, Oakland, CA (US); Benjamin Kiyoshi Guthrie, San Francisco, CA (US); Hunter Andrew Nordhauser, San Francisco, CA (US); Andrew John Coutant, Dublin, CA (US)

(73) Assignee: THE NORTH FACE APPAREL CORP., Wilmington, DE (US)

( * ) Notice: Subject to any disclaimer, the term of this patent is extended or adjusted under 35 U.S.C. 154(b) by 81 days.

(21) Appl. No.: 14/731,096

(22) Filed: Jun. 4, 2015

(65) Prior Publication Data

US 2016/0353864 A1 Dec. 8, 2016

(51) Int. Cl.
*A45F 3/04* (2006.01)
*A45C 13/00* (2006.01)
(Continued)

(52) U.S. Cl.
CPC ..... *A45F 3/04* (2013.01); *A45C 13/008* (2013.01); *A45C 13/103* (2013.01); *A45C 2005/037* (2013.01)

(58) Field of Classification Search
CPC ..... A45F 3/04; A45F 2004/006; A45F 4/02
(Continued)

(56) References Cited

U.S. PATENT DOCUMENTS 1,994,235 A 3/1935 Solomon
2,390,673 A * 12/1945 Wallace ..... A45F 3/10 224/235
(Continued)

FOREIGN PATENT DOCUMENTS

EP 1201150 A1 5/2002
EP 2214794 A 8/2010
(Continued)

OTHER PUBLICATIONS

Japanese Office Action issued Nov. 29, 2016 for co-pending JP Application No. 2015-256241 filed Dec. 28, 2015.
(Continued)

*Primary Examiner* — Brian D Nash
(74) *Attorney, Agent, or Firm* — Ganz Pollard, LLC

(57) ABSTRACT

The inventive subject matter is generally directed to a pack with an automatically opening compartment. The pack has a body that defines a volume for the containment of articles, and a strap system for supporting the pack in a user's body. A section of the pack is hingeably coupled to another body portion of the pack. The hingeable section has a first condition, providing an opening to a compartment in the pack, and a second condition, closing the opening to the compartment. The hingeable section is coupled to a spring system that is (1) unloaded when the hingeable section is in the first condition and (2) relatively loaded when in the second condition, so that the compartment automatically opens when the closure system is released. The pack may include a closure system for locking the hingeable section in the closed condition.

11 Claims, 8 Drawing Sheets

(51) Int. Cl.
*A45C 13/10* (2006.01)
*A45C 5/03* (2006.01)

(58) Field of Classification Search
USPC ..... 224/241, 235, 236
See application file for complete search history.

(56) References Cited

U.S. PATENT DOCUMENTS 2,764,327 A * 9/1956 Stevenson ..... A45F 3/04 224/236
3,662,932 A * 5/1972 Kerschner ..... A45F 4/02 224/155
4,392,598 A * 7/1983 Dixon ..... A45F 4/02 224/155
4,810,102 A * 3/1989 Norton ..... A45C 1/04 150/108
5,004,134 A * 4/1991 Barry ..... A45C 3/10 224/235
5,016,792 A * 5/1991 Jay ..... A47C 4/52 224/153
5,062,557 A * 11/1991 Mahvi ..... A45C 7/0086 190/108
5,135,144 A * 8/1992 Blakely ..... A61B 50/31 206/366
5,205,448 A * 4/1993 Kester ..... A45C 11/38 206/316.2
5,680,973 A * 10/1997 Vulpitta ..... A45C 9/00 108/43
5,878,928 A * 3/1999 Seiber ..... A45F 3/04 224/153
5,964,470 A * 10/1999 Syendsen ..... A47D 13/025 224/153
6,161,739 A * 12/2000 Bentzen ..... A45F 4/02 224/153
6,196,437 B1 * 3/2001 Smith, III ..... A45F 3/04 224/241
6,293,445 B1 * 9/2001 Miller ..... A45F 3/00 224/236
6,460,746 B1 * 10/2002 Amram ..... A45F 3/047 224/579
6,944,015 B1 * 9/2005 Jenkins ..... G06F 1/1626 224/197
7,350,682 B2 * 4/2008 Meyer ..... A45F 3/047 224/262
7,665,642 B2 * 2/2010 Abbate ..... A45C 9/00 224/153
7,828,145 B2 * 11/2010 Grander ..... A45F 3/04 206/315.1
7,971,764 B2 * 7/2011 Sabbah ..... A45C 13/02 224/650
8,038,042 B2 * 10/2011 Bartel ..... A45C 5/14 224/153
8,201,837 B2 * 6/2012 Dweek ..... A45C 5/146 224/153
8,292,139 B2 * 10/2012 Golub ..... B62J 7/08 224/419
2004/0065708 A1 * 4/2004 Amram ..... A45F 3/047 224/579
2004/0188202 A1 9/2004 Chuang
2007/0012735 A1 * 1/2007 Lee ..... A45F 3/08 224/155
2009/0071782 A1 3/2009 Rasmussen
2010/0301078 A1 * 12/2010 Tamir ..... A45F 4/02 224/155
2011/0198374 A1 8/2011 Majeau
2016/0100672 A1 * 4/2016 Raske ..... F41C 33/02 224/241

FOREIGN PATENT DOCUMENTS

GB 590234 A 7/1947
JP 2004-129734 A 4/2004
JP 2007514213 5/2007
JP 2010-167182 A 8/2010
JP 2014511743 5/2014
WO 2009072981 A1 6/2009
WO 2012143521 A1 10/2012

OTHER PUBLICATIONS

Extended European Search Report in Application No. 16175919.6 dated Oct. 27, 2016.

* cited by examiner

AUTOMATIC OPENING FOR A COMPARTMENT IN A PACK

BACKGROUND

The inventive subject matter is generally directed to packs, such as wearable packs like backpacks, daypacks, rucksacks, knapsacks, bike messenger bags, and other carriers of packed items like suitcases, travel cases, duffel bags, and brief cases. It is particularly directed to a pack with a compartment that automatically opens on once a closure is released.

Packs have been long known. They have one or more compartments for storage of a user's items. Typically, the compartments are secured by closure systems such as zippers, drawing string systems, snap fasteners, hook and loop fasteners, etc. The design of the packs and closure system is such that opening and accessing the compartment is manually intensive. The front and back portions of the pack may collapse onto one another requiring manual separation to add items into pack, or to sort through items already in the pack. Such effort causes delay and frustration in storing or retrieving items.

In modern times, security checkpoints confront us at airports, courthouses, concerts and other facilities. They are places where rapidity is needed to keep pace with the queue. Delays in retrieving and storing items in the process of security clearances can be especially stressful. Prior art designs for wearable packs disadvantageously do not facilitate ease of access to compartments in packs. Accordingly, there is a need for improved packs that efficiently allow access to compartments.

SUMMARY

The inventive subject matter is generally directed to a pack with an automatically opening compartment. The pack has a body that defines a volume for the containment of articles, and a strap system for supporting the pack in a user's body. A section of the pack is hingeably coupled to another body portion of the pack. The hingeable section has a first condition, providing an opening to a compartment in the pack, and a second condition, closing the opening to the compartment. The hingeable section is coupled to a spring system that is (1) unloaded when the hingeable section is in the first condition and (2) relatively loaded when in the second condition, so that the compartment automatically opens when the closure system is released. The pack may include a closure system for locking the hingeable section in the closed condition.

In the foregoing and other embodiments: the hingeable section may comprise a pliable material; the hingeable section may hinges at a joint comprising a flexure bearing or living hinge formable in the pliable material; the joint may be formed of a material that is more flexible or thinner than a body portion of the pack adjacent the joint off of which the hingeable section hinges; the hingeable section may include a movable frame member that is pivotably connected to the body portion of the pack and coupled to the spring system; the movable frame member may have a generally U-Shape, the closed end of the U-shaped member being coupled to the hingeably section at a top edge and having downwardly extending legs that pivotably couple with opposite sides of a body portion of the pack; the spring system may be pivotably coupled to at least one leg of the frame member; the spring system may comprise a mechanical spring; the spring system may comprise a torsion spring; the spring system may comprise a materials-based spring; the hingeable section may be disposed at an upper front portion of the pack; the hingeable section may be disposed at an upper front portion of the pack and may be pivotable relative to a back portion so as to create an opening at the top of the pack; the opening may be for a main compartment of the pack; the opening may be for a compartment of the pack sufficiently sized and shaped to hold a laptop or tablet computer.

In any contemplated embodiment, the pack may be a wearable pack having at least one body strap coupled to the body. The wearable pack may be a backpack having a pair of shoulder straps coupled to the body of the pack.

In certain embodiments, the inventive subject matter is directed to a wearable pack, comprising: a body defining a volume for the containment of articles, the body generally having a height, width, and depth, and at least one body strap coupled to the body; a hingeable section hingeably coupled to a body portion of the pack, the hingeable section having a first condition providing an opening to a compartment in the pack and second condition closing the opening to the compartment; a closure system for locking the hingeable section in the closed condition; and the hingeable section being coupled to a spring system that is unloaded when the hingeable section is in the first position and relatively loaded when in the second position, so that the compartment becomes automatically open when the closure system is released; wherein the hingeable section includes a movable frame member that is pivotably connected to the body portion of the pack and coupled to the spring system; and wherein the hingeable section is disposed at an upper front portion of the pack and is pivotable relative to a back portion so as to create an opening at the top of the pack; and wherein the hingeable section hinges along a joint comprising a flexure bearing or living hinge formed in a pliable material.

In certain embodiments, the inventive subject matter is directed to a method of making a pack, comprising: providing a body defining a volume for the containment of articles, the body generally having a height, width, and depth, and at least one body strap coupled to the body; providing the pack with a hingeable section, the hingeable section having a first condition providing an opening to a compartment in the pack and second condition closing the opening to the compartment; providing the pack with a closure system for locking the hingeable section in the closed condition; and providing the pack with a spring system that is coupled to the hingeable section and is unloaded when the hingeable section is in the first position and relatively loaded when in the second position, so that the compartment becomes automatically open when the closure system is released.

The foregoing is not intended to be an exhaustive list of embodiments and features of the inventive subject matter. Persons skilled in the art are capable of appreciating other embodiments and features from the following detailed description in conjunction with the drawings. These and other embodiments are described in more detail in the following detailed descriptions and the figures. The appended claims, as originally filed in this document, or as subsequently amended, are hereby incorporated into this Summary section as if written directly in.

BRIEF DESCRIPTION OF THE DRAWINGS

The appended figures show embodiments according to the inventive subject matter, unless noted as showing prior art.

DETAILED DESCRIPTION

Figure 1:
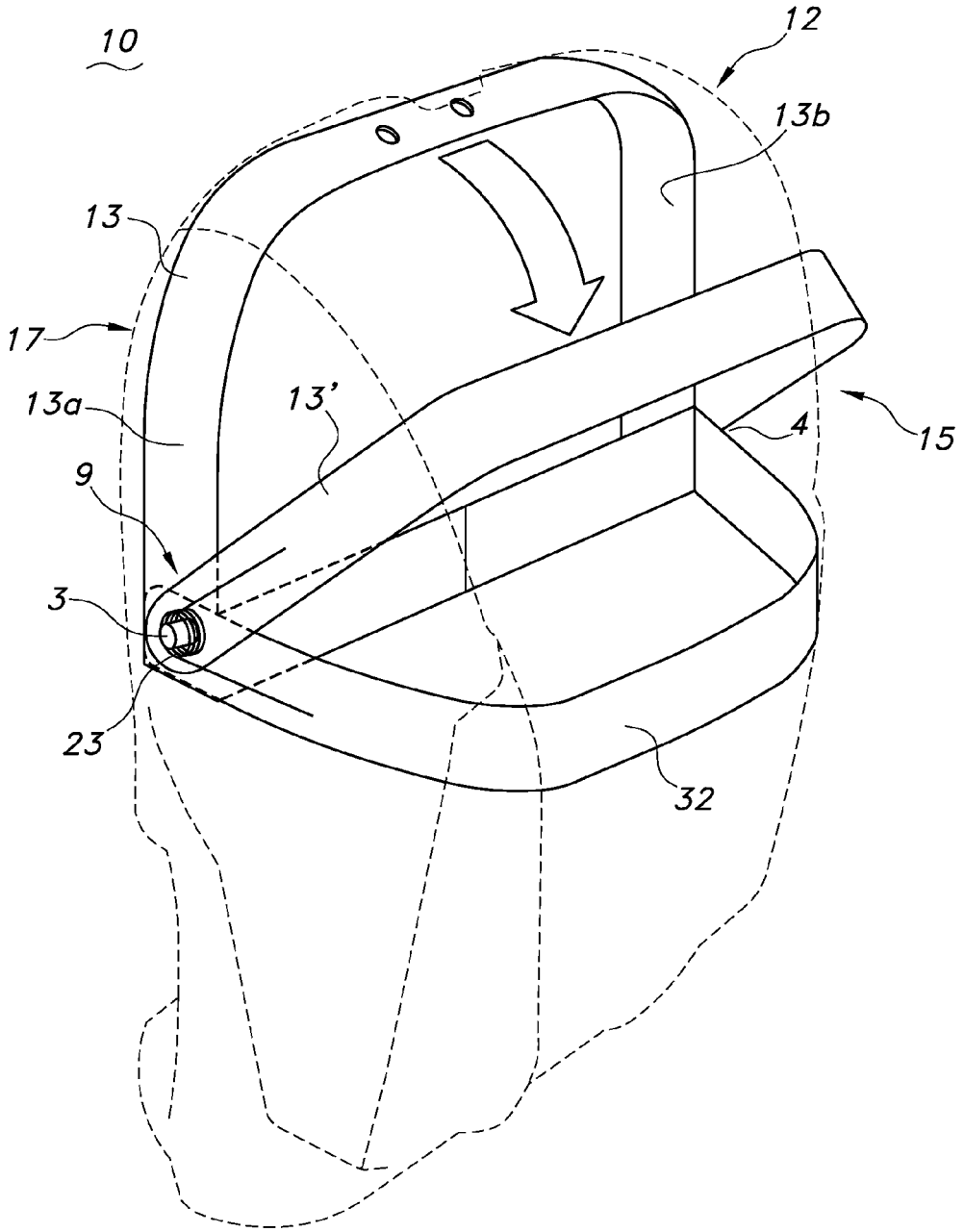
FIG. 1 shows a front side, left perspective view of one possible embodiment of a spring-loaded frame system for a wearable pack with backpack conceptually superimposed over the frame to indicate how the frame associates with the pack.
Figure 2:
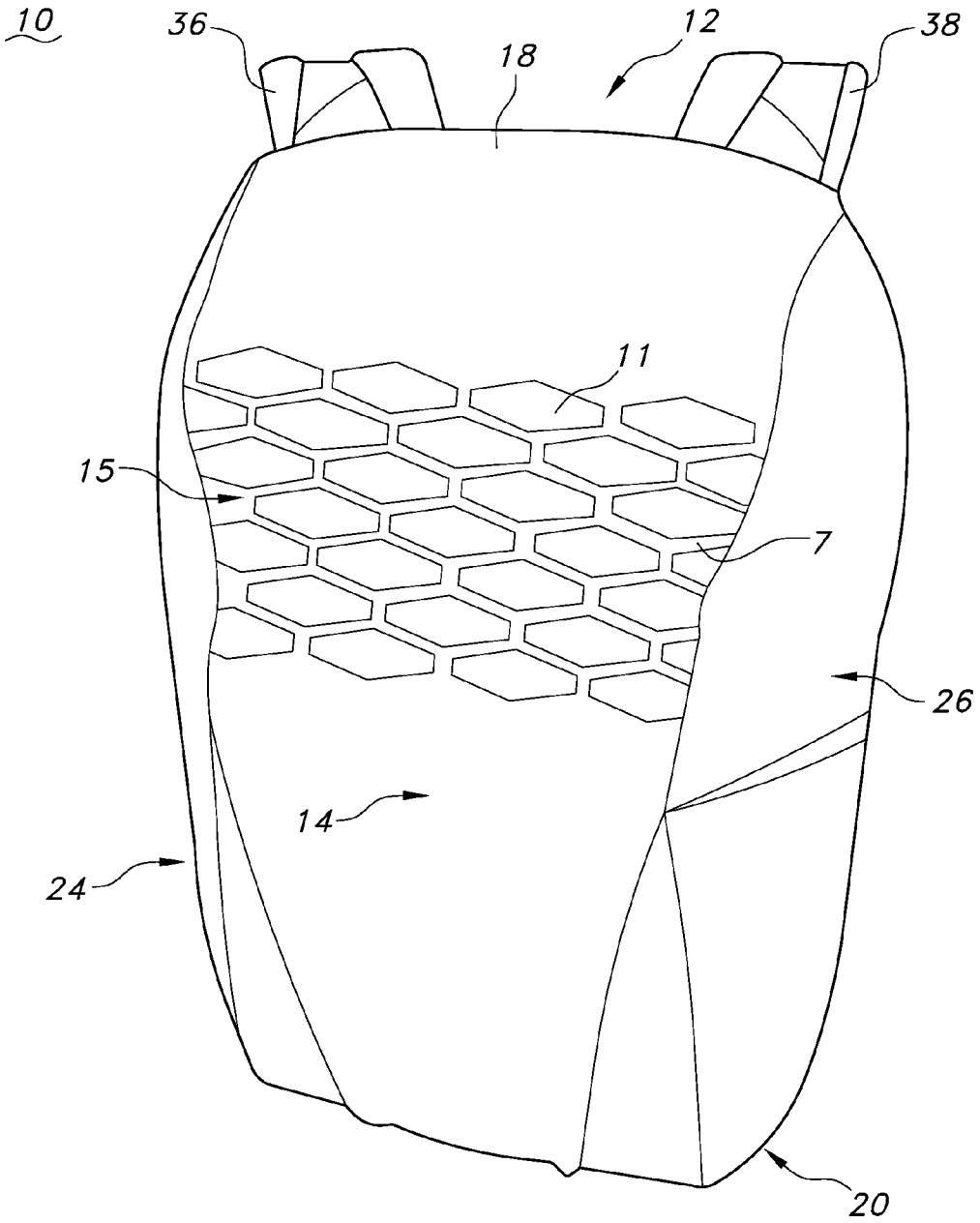
FIG. 2 shows a front view of a wearable pack incorporating a spring-loaded frame system like the one of FIG. 1 with a first compartment in the pack in an open condition.
Figure 3:
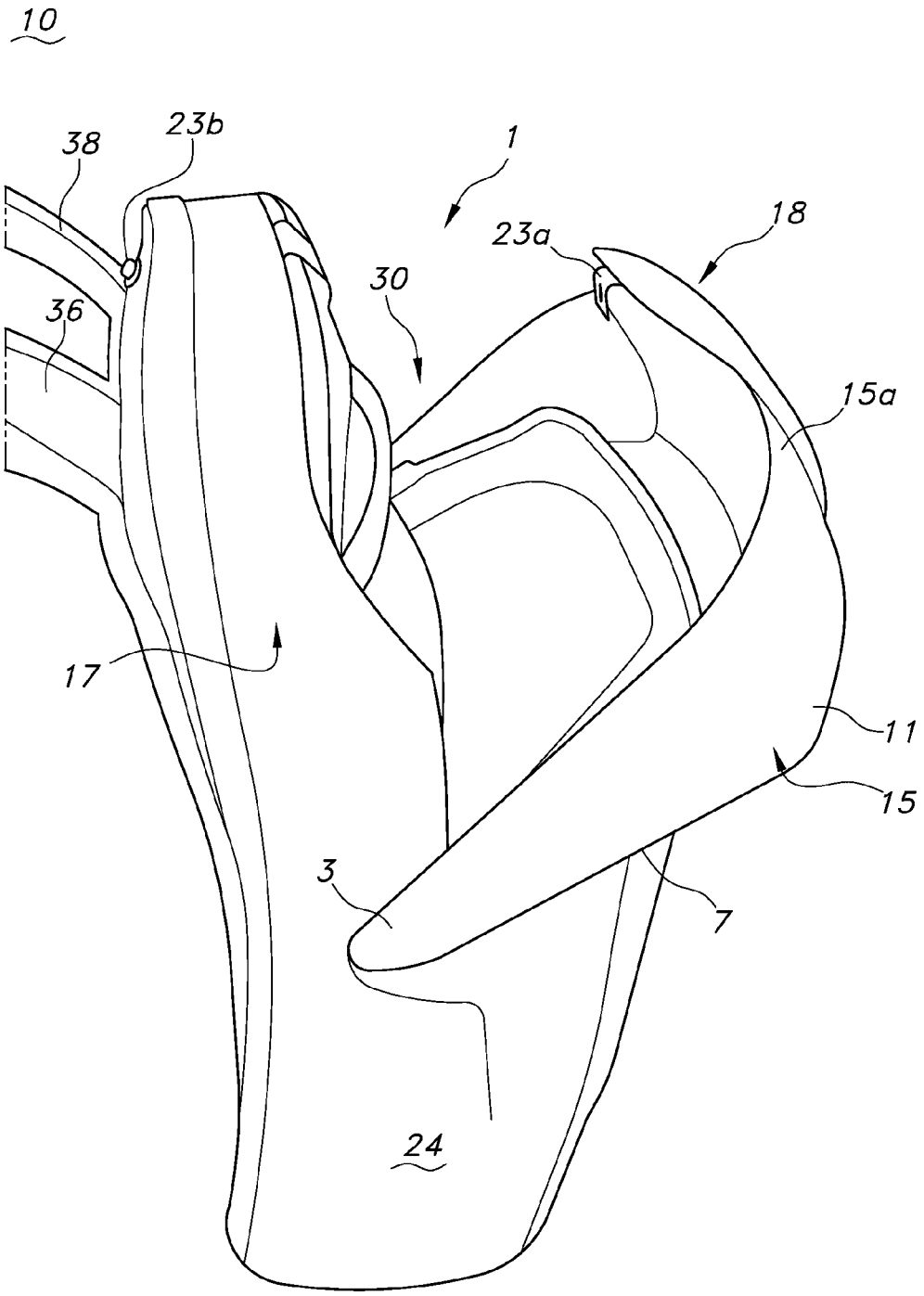
FIG. 3 shows a left side elevational view of the wearable pack of FIG. 2 with the compartment in an open condition.
Figure 4:
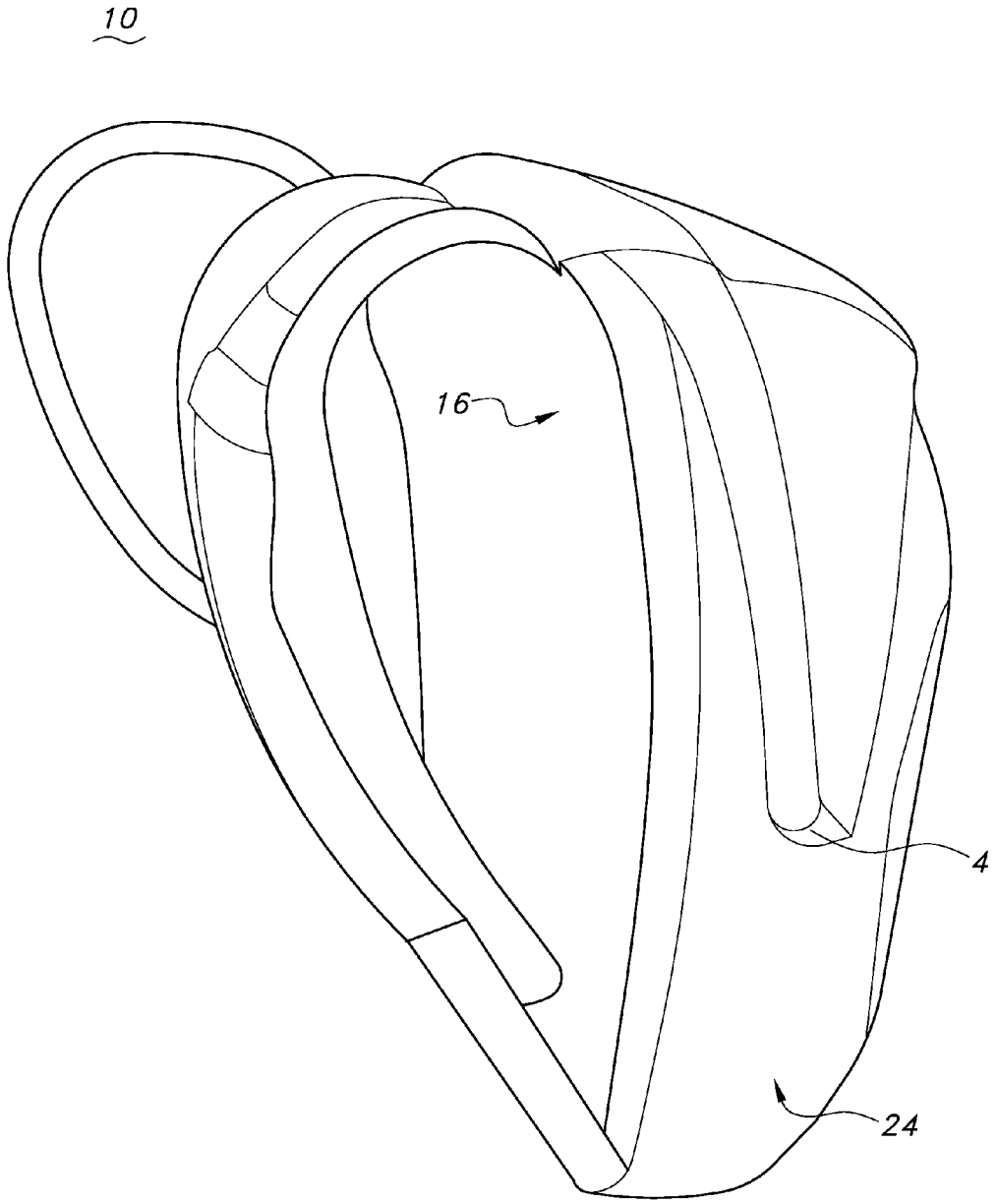
FIG. 4 shows a left side elevational view of the wearable pack of FIG. 2 with the compartment in a closed condition.
Figure 5:
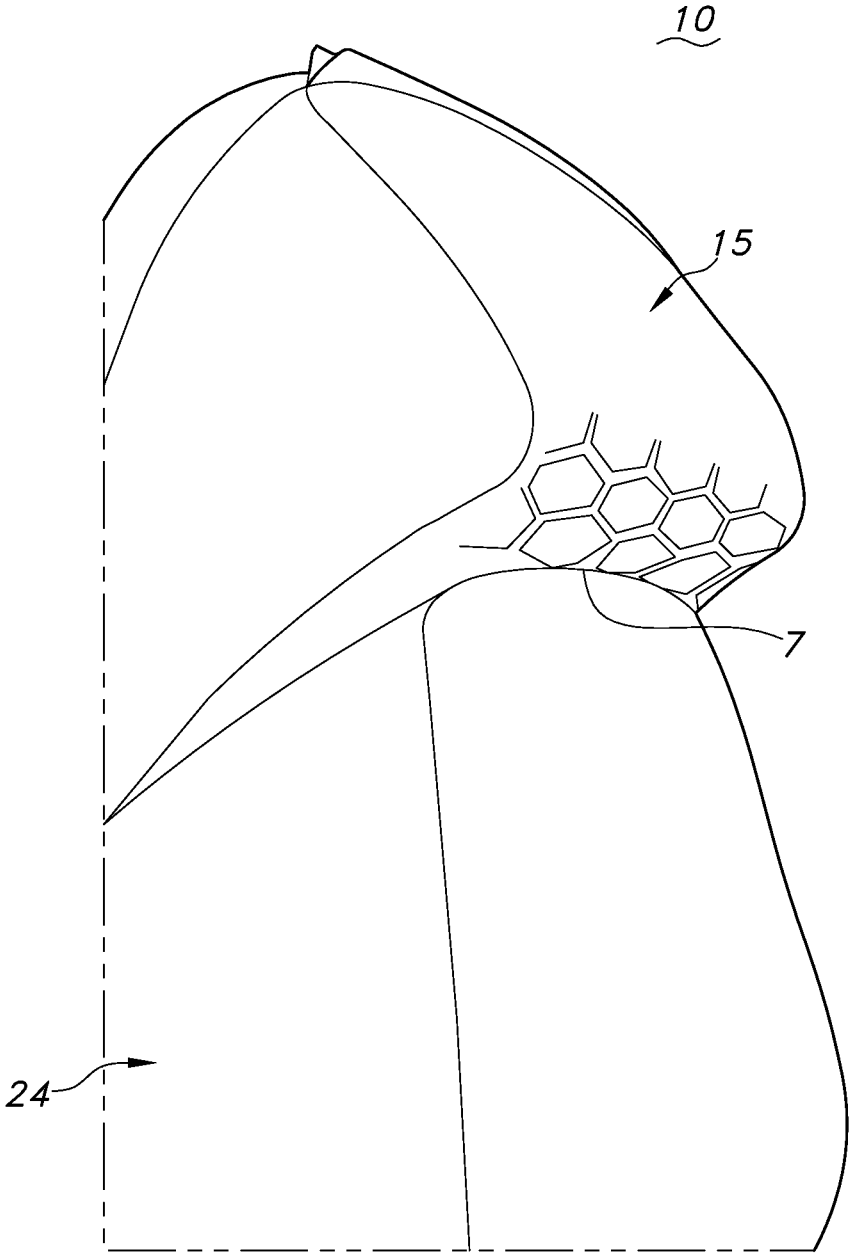
FIG. 5 shows a front side, left perspective view of the pack of FIG. 2 with the compartment in an open condition.
Figure 6:
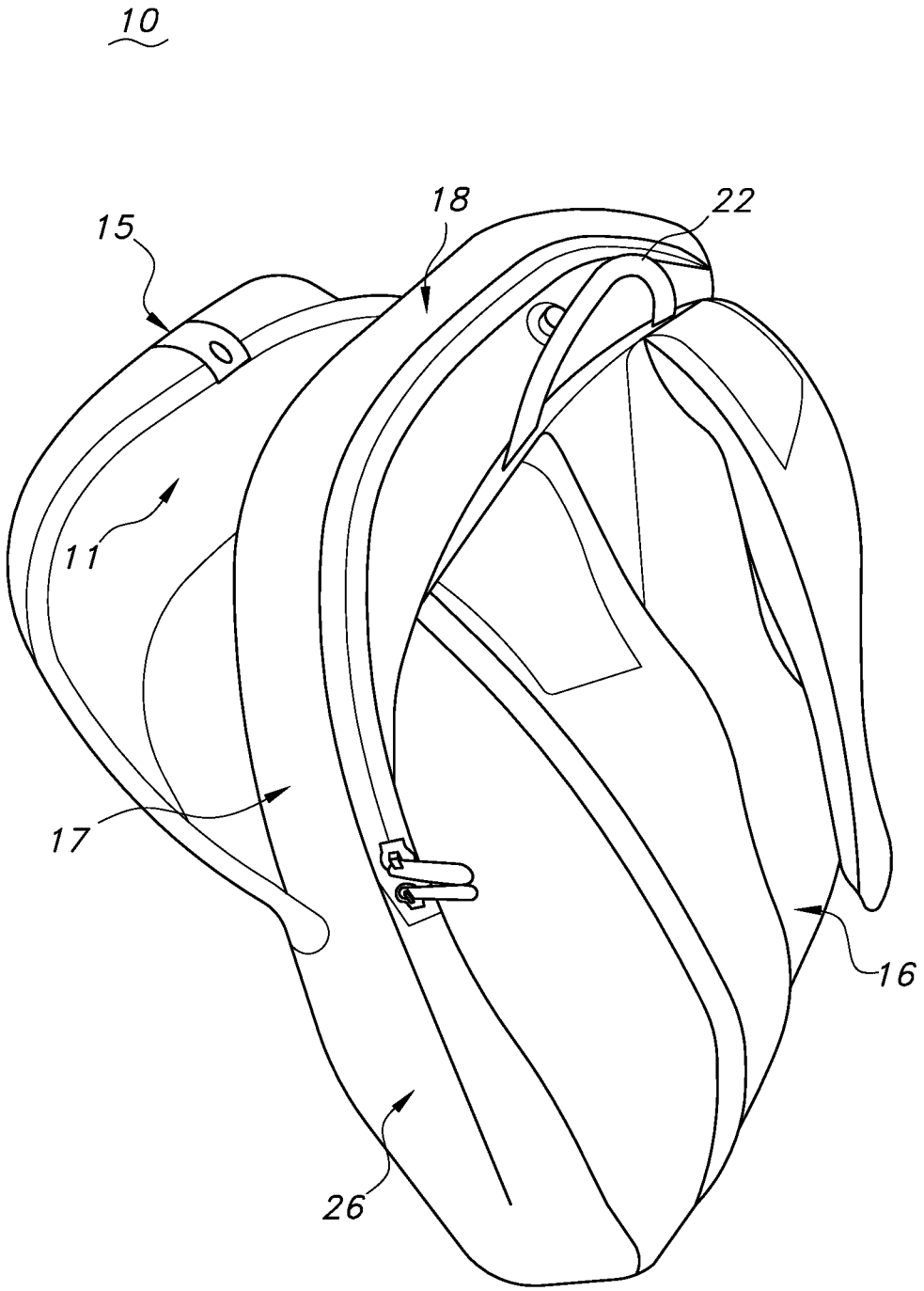
FIG. 6 shows a rear side, right perspective view of the pack of FIG. 2 with the compartment in an open condition.

Representative embodiments according to the inventive subject matter are shown in FIGS. 1-7, wherein the same or generally similar features share common reference numerals.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

The term "wearable pack", as used herein, refers broadly to wearable packs with shoulder straps, along the lines of backpacks, rucksacks, daypacks, hip packs, messenger bags, totes and other packs with one or more shoulder straps. "Backpack", unless context indicates otherwise, means a pack with a pair of shoulder straps. A pack that does not self-support on the body via a body-retaining strap or other support is not a wearable pack. For example, a suitcase with only a handle is a pack that is not wearable.

The inventive subject matter is generally directed to a wearable pack with an automatically opening compartment. The pack has a body that defines a volume for the containment of articles, and a strap system for supporting the pack in a user's body. A section of the pack is hingeably coupled to another body portion of the pack. The hingeable section has a first condition, providing an opening to a compartment in the pack, and second condition, closing the opening to the compartment. The hingeable section is coupled to a spring system that is loaded when (1) the hingeable section is in the first condition and (2) relatively unloaded when in the second condition, so that the compartment automatically opens when the closure system is released. The pack may include a closure system for locking the hingeable section in the closed condition.

FIGS. 1-8B illustrate possible embodiments of a wearable pack 10, which in this case is a backpack. The embodiment shown will generally be used to illustrate the inventive subject matter, although the inventive subject matter is not to be limited by them. The body 12 of the pack 10 has an overall construction of at least a front surface 14, a back surface 16, a top surface 18, a bottom surface 20, and side surfaces 24 and 26 that interconnect with the other surfaces. The arrangement of the surfaces defines one or more volumes, i.e., compartments, for containment of articles. In the context of surfaces 14, 16, 18, 20, 24, and 26, the term "surfaces" is used broadly to mean a generally sheet- or panel-like structure with a side that faces outward and a side that faces inward when assembled into the body of the pack. The surfaces need not come together in discrete joints; they may merge in curving interfaces, for example. Typically, the surfaces are made of a pliable material, such as one or more layers of a knit or a woven or non-woven textile, but the pack may be made in whole or part of shape-holding, semi-rigid or rigid materials, such as plastics, polymer foams, metals, and/or composites.

In at least the case of backpacks, the body is generally sized and shaped so that it fits comfortably against the back of the wearer. In some cases, it may be contoured to conform to the contours of anatomy of a back. Generally, it is dimensioned so as not to exceed about the width of the back, or the length between the waist and shoulders of the intended wearer. Backpacks may be sized and shaped differently to accommodate variations in height, e.g., small, medium, or large. Or they may be sized and shaped to fit gender or age categories, e.g., men, women, or children. Notably, the top side or bottom side surfaces or both could be essentially eliminated in whole or part by merging together the top edges of the front surface 14 and back surface 16, and/or the bottom edges of the front surface 14 and the back surface 16, creating wedges (not shown or present in the illustrated embodiment) where the surfaces join. Similarly, surfaces could be reduced in profile by using curves, for example, to merge surfaces. The side surfaces 24 and 26 could also be joined or merged in similar fashion. The surfaces are not necessarily continuous surfaces—zippers, netted sections, and cords may interrupt them for example.

Typically, the body of a pack includes a closeable opening 1 for access to a compartment in the pack. In the embodiment shown, opening 1 provides access at the top of the pack to main compartment 30. The opening may extend down one or both sides of the pack to a desired degree. The opening may be secured in the closed condition by a closure system 23*a*, 23*b*, such as a mechanism based on interlocking male/female parts, e.g., snaps; a zipper; hook and loop fasteners; buttons, etc.

The opening is created by the separation of a portion of the pack from another portion. The Figures show a front portion 15 of the pack being movable from a back portion 17 of the pack along around a hinge. As used herein, a "hinge" is a type of bearing that connects or is an interface for two solid objects, allowing some angle of rotation between the objects. Two objects connected by an ideal hinge rotate relative to each other about a fixed axis of rotation. Hinges may be made of flexible material or of separate moving components. As used herein, "hinge" encompasses flexure bearing and living hinges, as well as mechanical hinges. According to the inventive subject matter, the hingeable section is spring loaded via spring system so that a compartment in the pack automatically opens once the user releases the hingeable section from a closed condition, e.g., by unlatching or otherwise disengaging a closure mechanism that keeps the hingeable section secure to the body portion.

In the embodiment shown, the hingeable section 11 hinges along a joint 7 that defines a lower end of the hingeable section and the top of a static portion of the pack that supports the hingeable section. The line of the joint that may be disposed orthogonally or transversely to the long axis of the pack. It may be linear or follow any other desired or natural path that supports hinging. The joint may represent a flexure bearing or living hinge formed in the pack material that allows the hingeable section to articulate relative to the body portion disposed below the hingeable section. The joint may be formed of a more flexible material or a thinner material that more easily flexes relative to the body portion. Or the hingeable material may be formed of the same material and in the same thickness as the body portion below but with a groove or other flexural line formed in the material to allow hinging. It should be appreciated that the hingeable section could be formed on a back portion of the pack or on lower portions of the front or back of the pack, and that a single pack may have multiple hingeable sections in such areas.

In the embodiment shown, the closeable opening 11 is provided via a frame system 9 that is part of a hingeable section 11 that forms part of a closeable compartment. The frame system includes a movable frame element 13 that is associated with or integrated with an edge 15*a* of a front portion 15 of the pack that engages with a back portion 17 to close the main compartment 30. In a closed condition, hingeable section 11 is disposed along the top 18 and/or sides 24, 26 of the pack. The body may have other openings into the main compartment, which may be closeable openings or permanent openings. For example, there may be openings from the front, sides, and/or bottom surfaces of the pack.

In the embodiment shown, the hingeable section has an associated frame system 9 consisting of a generally U-shaped frame 13 made of a rigid or semi-rigid material. For example, the frame may be made of spring-steel, aluminum, or a moldable plastic, such as ABS or polyethylene. The frame may be a unitary piece of material or it may be constructed from separate pieces that are connected together. The closed end of the U (crossbar portion) is disposed along and coupled to a top edge of the front portion 15. The legs extend downwardly along sides of the front portion. The bottoms of the legs are pivotably anchored to opposing sides of the pack at pivot points 3, 4 so that the frame 13 is rotatable coupled to the sides of the back portion 17 of the pack. The anchoring material may be a rigid material such as metal or plastic that is coupled to the body of the pack or that forms the relevant portion of the pack.

FIG. 1 shows the pack conceptually superimposed over the frame system. The frame 13 is shown in a first, closed position. The same element 13' is also shown as it would appear in the open position. A spring system 21 is associated with the pivot points 3, 4 so that in the spring system's relaxed state hingeable section 11 is in an open condition. As the hingeable section is moved into the closed position, the spring system is loaded. Spring system 21 may consist of any one of various known mechanical springs or materials-based springs. As shown in FIG. 1, for example, the spring system may be one or more torsion springs disposed along the joint for the hingeable section. In the embodiment shown, one arm of the torsion spring is coupled to a leg 13*a* of the frame 13 and the other is coupled to the back portion 17 of the pack. A second torsion spring at the opposite side of the pack (not shown) may be coupled to the opposite of leg 13*b* of frame 13 in the same way. Although the legs are shown ending at the pivot points, the legs may extend below the pivot points to provide structural framework for the pack.

In other possible embodiments, the hingeable section may be coupled directly or indirectly to the back portion by a compression spring that compresses and is loaded as the hingeable section is moved into and secured in the closed position. When released from the closed position, the compression spring automatically unloads and returns the hingeable section to the open position. The torsion spring could be located at one or both pivot axes or in between the axes.

Figure 8A:
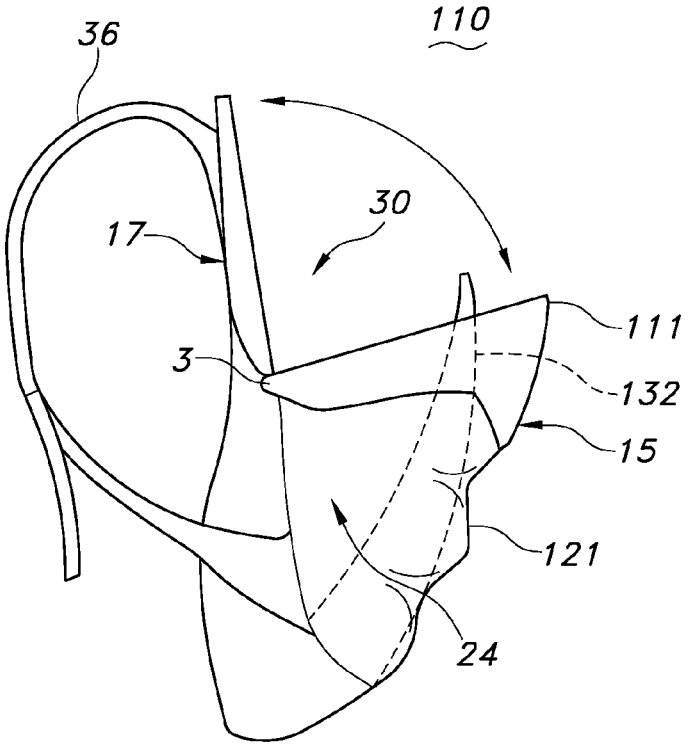
FIGS. 8A-8B show a side elevational view of an alternative embodiment in different conditions.
Figure 8B:
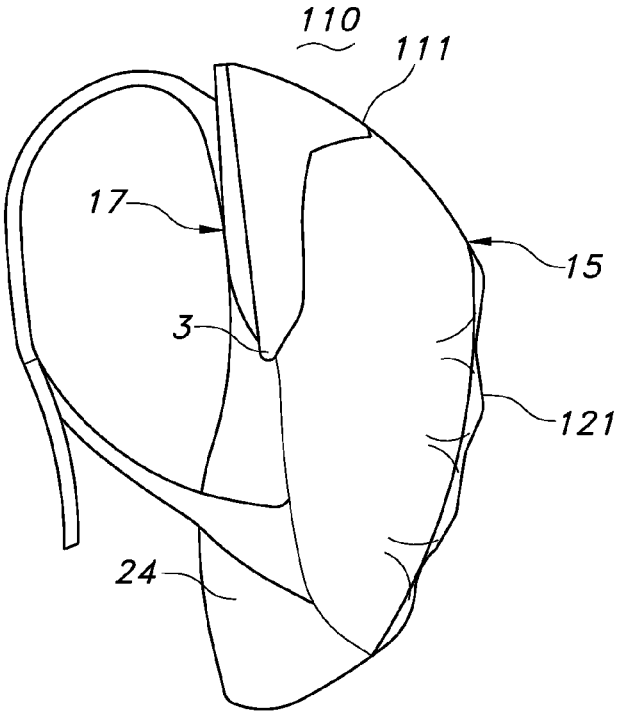

Another possibility is a materials-based spring system such as an elastic fabric or band. For example, the hingeable section 11 may be coupled directly or indirectly to a lower portion of the body of the pack that is in elastic tension with the hingeable section. For example, the coupling could be by an elastic panel or by gussets disposed on the sides of the hingeable section. An example of an elastic panel 121 for pack 110 is seen in FIGS. 8A-8B. The pack is similar to the pack of FIG. 1 but does not need to have springs associated with the pivot points 3, 4 because of the use of the elastic material. As the hingeable section 111 is pulled upwardly away from the lower body portion to close the main compartment 30, the material is loaded. A frame element 132 may be associated with the body of the pack to define a volumetric shape for the body. When released, it will exert a return force that returns the hingeable section to an open condition. A similar coupling arrangement could be achieved by replacing the elastic material with a tension spring or elastic cords, which would be integrated into the body of the pack.

When the hingeable section 11 is in the closed position, a closure system 23*a*, 23*b* may be used to lock it in place. When the closure is released, the hingeable section springs into the open position, providing easy and immediate access to the main compartment without the need for the user to manual open the compartment, other than releasing the closure. It should be appreciated that the automatically opening compartment is not limited to main compartments. It may be any one or more compartments in the pack.

Another possibility for a spring system is a resilient jaw-like system, i.e., with one portion integrated with a hingeable section and the other with a relatively static body portion. The jaws would face up, with the open space for the jaws also being the opening for the compartment. The jaw portions may be a unitary structure formed of a shape memory material (e.g., metal or polymer), with the upper and lower portion hinging around a flexural bearing or living hinge. The jaws portions are loaded when pressed together and unloaded when apart. Thereby, the jaw portions automatically return to the open position when unsecured from each other.

While the foregoing discussion describes the hingeable section 11 as having a discrete frame system incorporated into the movable body portion, the movable body portion could be monolithically formed of a semi-rigid or rigid material to eliminate the need for a separate frame components.

In addition to a movable frame system, the pack may have static frame elements that help support the pack in a desired configuration, such as frame element 32 or 132, which helps keep the front portion and back portions of the pack separated, maintaining the structure and volume of the main compartment. In doing so, the hingeable section 11 is more easily aligned with the back portion 17 for closure. The static frame element may be semi-rigid to allow some resilient flexibility to the pack but still generally holding a compartment in a desired shape.

Figure 7:
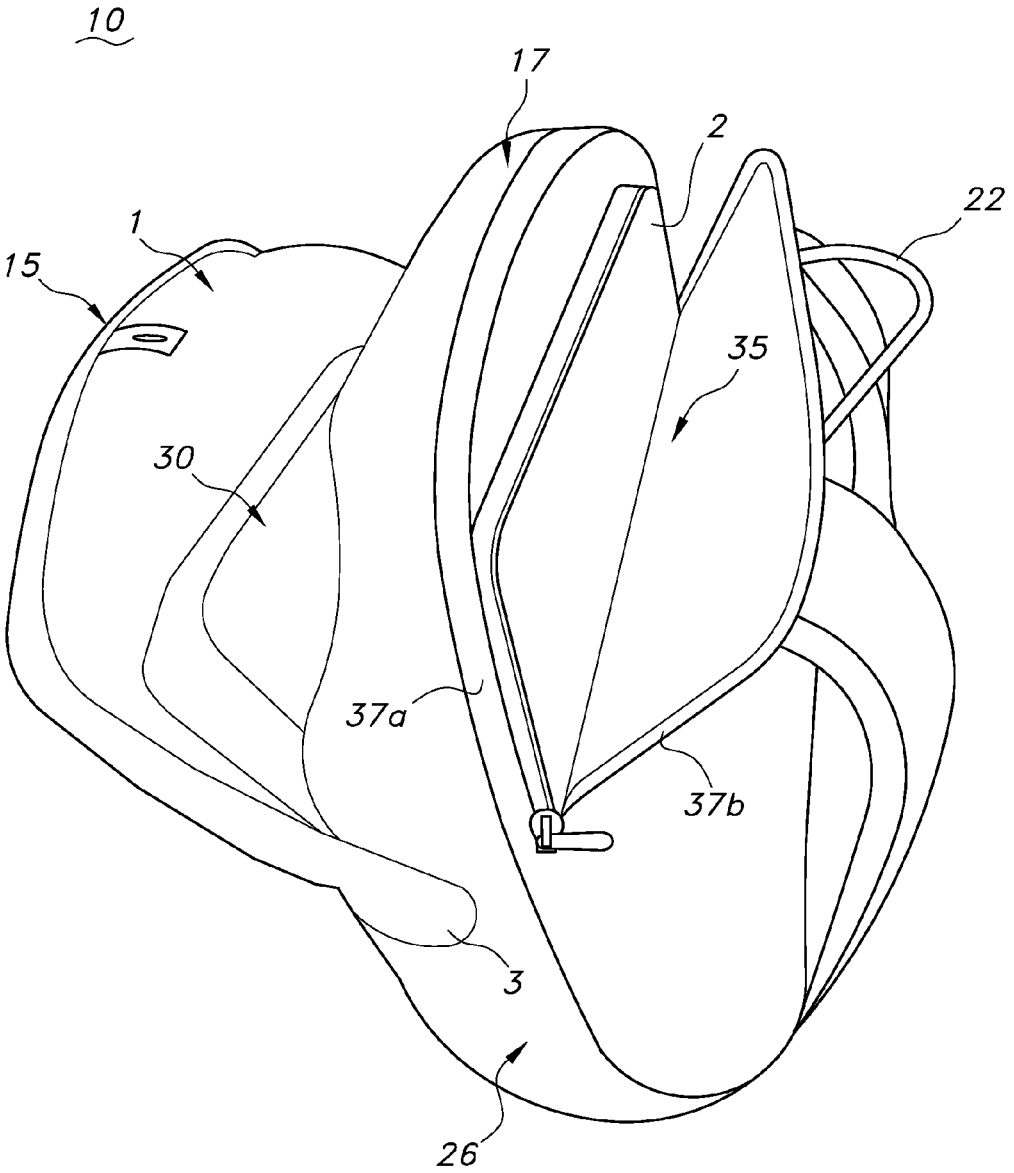
FIG. 7 shows a right side elevational view of the wearable pack of FIG. 2 with a first compartment in the pack in an open condition and an optional second compartment in the pack in an open condition.

The pack optionally may have a dedicated laptop or tablet computer compartment 35 that is accessed at the back panel area, as seen in FIG. 7, which may or may not automatically open. Access to that compartment may be provided via a zipper running from part way up one side, around the top, to part way down the other side. The laptop compartment zipper is away from the straps, so access is secure, yet easy.

In general, the size of a compartment for a laptop or tablet computer should be configured to have a size that store and enclose a device with minimum dimensions of 20 cm (height) by 12 cm (width) by 10 cm (depth).

In addition to the main compartment, the body may include any number of other compartments for containment of articles. Other compartments may be arranged adjacent, side-to-side or up and down relative to the main compartment or to each other. The body, including any of its compartments, may also have pockets arranged on the inside or outside of the compartments. For example, a pocket (not shown) may also be arranged on the front of body 12. As used herein, "compartments" refers to relatively large areas for holding things such as, sleeping bags, laptops, articles of clothing, books, etc. Generally, "pockets" refers to relatively smaller areas for holding things, such as wallets, mobile phones, media players, water bottles, etc. However, there is not always a clear dividing line between what a compartment is and what a pocket is, beyond the main compartment of a pack. FIG. 7 shows an optional backside-accessible compartment 35, separated from the main compartment 30, for storing an object such as a laptop 2. The compartment may be accessed by, for example a zipper system 23*a*, 23*b*.

The body strapping system coupled to the wearable pack may be one or more discrete items connected to the body. Or they may be structures that are integrated with the body that are, for example, woven, knitted or molded in a unitary form with the body of the pack. The strap system may be a pair of shoulder straps, as is known in conventional backpack. Or it may be a long, single strap that is configured to fit over one shoulder of and across a wearer's chest and under the arm opposite the shoulder, as is known in the case of bike messenger bags, for example.

As used herein, "strap" is meant to refer to not only pliable, webbing and band-like structures but also individual filaments or bundles of filaments, chains, cords, cables, etc. that provide the functionality for the purposes described herein. A strap may have an elastic or inelastic construction. It may also have a construction of elastic and inelastic sections.

The backpack shown in the figures includes one or more shoulder straps, in the illustrated example, straps 36 and 38. The shoulder strap system can be based on single-ply straps of material or they can be a composite of materials, as is known in higher-end backpacks for carrying heavier loads. Often, the portion of the shoulder strap that bears against a wearer's body is made using a padded or cushioning material or construction. For example, it may be a composite of a cellular foam material, such as polyurethane, molded or cut EVA foam (ethylene-vinyl acetate), padded mesh—often known as nylon or polyester spacer mesh—surrounded by or joined to a fabric such as nylon.

In addition to the shoulder straps for carrying the body of the pack on the body of a wearer, the pack may optionally include a handle or grip 22.

The body 12 of a pack may be constructed of one or more plies of thin, pliable material. Typical pliable materials for use in the body include, natural and synthetic materials, Nylon fabrics, polyester fabrics, natural or synthetic rubber or rubber-like plies of material, animal hides (e.g., leather), cotton, canvas, hemp, wool, and fabric blends. These materials can be used singly or in combination with each other. The body may be formed using materials having continuous surfaces such as Nylon plain weave or twill fabric or perforated surfaces such as net or web structures.

Frame elements may be associated with the pliable materials or other body forming materials by incorporating them between layers or by affixing them on exterior or interior surfaces of the materials. Further, a panel or portion of the pack may be monolithically molded or otherwise formed of a rigid material to provide a rigid or semi-rigid structure.

The principles described above in connection with any particular example can be combined with the principles described in connection with any one or more of the other examples. Accordingly, this detailed description shall not be construed in a limiting sense, and following a review of this disclosure, those of ordinary skill in the art will appreciate the wide variety of systems that can be devised using the various concepts described herein. Moreover, those of ordinary skill in the art will appreciate that the exemplary embodiments disclosed herein can be adapted to various configurations without departing from the disclosed principles.

As used herein, unless context indicates otherwise, "coupling" (and variations of the word) means parts or portions of different functions that are physically connected separate items or physically formed as integrated or unitary structures.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more".

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

The inventors reserve all rights to the subject matter disclosed herein, including the right to claim all that comes within the scope and spirit of the following claims:

1. A backpack, comprising:

a body defining a volume for the containment of articles, the body generally having a front surface and an opposing back surface, opposing side surfaces, and opposing top and bottom surfaces, the surfaces being arranged to define a compartment of a backpack;

the front surface having upper and lower portions, the upper portion comprising a hingeable section hingeably coupled to the lower portion, the hingeable section having a first condition providing an opening to the compartment in the pack and a second condition closing the opening to the compartment, wherein the front portion is movable relative to the back portion by the front portion's hinging along a joint that is defined by (1) a lower end of the hingeable section and (2) the top end of the lower portion of the front surface;

a closure system for locking the hingeable section in the closed condition;

wherein the hingeable section being coupled to a spring system that is unloaded when the hingeable section is in the first condition and relatively loaded when in the second condition, so that the compartment automatically opens when the closure system is released;

wherein the hingeable section includes a movable frame member that is pivotably connected to the body portion of the pack and coupled to the spring system; and wherein the movable frame member comprises a generally U-Shape, the closed end of the U-shaped frame member being coupled to the hingeably section at a top edge and having downwardly extending legs that pivotably couple with opposite sides of a body portion of the pack.

2. The pack of claim 1 wherein the hingeable section comprises a pliable material.

3. The pack of claim 2 wherein the hingeable section hinges at a joint comprising a flexure bearing or living hinge formable in the pliable material.

4. The pack of claim 3 wherein the joint is formed of a material that is more flexible or thinner than a body portion of the pack adjacent the joint off of which the hingeable section hinges.

5. The pack of claim 1 wherein the spring system is pivotably coupled to at least one leg of the frame member.

6. The pack of claim 1 wherein the spring system comprises a mechanical spring.

7. The pack of claim 1 wherein the spring system comprises a torsion spring.

8. The pack of claim 1 wherein the spring system comprises a materials-based spring.

9. The pack of claim 1 wherein the hingeable section is disposed at an upper front portion of the pack.

10. The pack of claim 1 wherein the opening is for a main compartment of the pack.

11. The pack of claim 1 wherein the opening is for a compartment of the pack sufficiently sized and shaped to hold a laptop or tablet computer having dimensions of at least 20 cm by 12 cm.

* * * * *